United States Patent [19]

Linse

[11] 4,079,977

[45] Mar. 21, 1978

[54] APPARATUS FOR USE IN BUILDING

[76] Inventor: Alois Josef Linse, 35, Meadway, Kelvin, Sandton, Johannesburg 2001, Transvaal, South Africa

[21] Appl. No.: 707,258

[22] Filed: Jul. 21, 1976

Related U.S. Application Data

[63] Continuation of Ser. No. 511,265, Oct. 2, 1974, abandoned.

[30] Foreign Application Priority Data

Jun. 28, 1974 South Africa ..... 74/4198

[51] Int. Cl.[2] ..... E04G 21/20

[52] U.S. Cl. ..... 294/3.5; 15/235.4; 52/749

[58] Field of Search ..... 294/1 R, 3.5, 7, 49, 294/51, 54, 55, 57, 58; 15/235.3–235.8, 236 R; 52/747, 749, 750, DIG. 1

[56] References Cited

U.S. PATENT DOCUMENTS

| | | | |
|---|---|---|---|
| 853,171 | 5/1907 | Healy et al. | 294/54 X |
| 1,026,117 | 5/1912 | Parkhill | 52/749 |
| 1,297,541 | 3/1919 | Campbell | 15/235.4 |
| 1,662,170 | 3/1928 | Sahlstrom | 294/51 |
| 1,851,497 | 3/1932 | Darling | 15/235.3 X |
| 2,416,414 | 2/1947 | Spencer | 294/58 |
| 3,020,575 | 2/1962 | Mullicane | 15/235.3 |
| 3,384,943 | 5/1968 | James | 15/235.3 X |
| 3,403,419 | 10/1968 | Hazelrigg | 15/235.3 |
| 3,608,944 | 9/1971 | Turner | 294/3.5 |

FOREIGN PATENT DOCUMENTS

| | | | |
|---|---|---|---|
| 531,641 | 10/1956 | Canada | 52/749 |
| 1,087,477 | 2/1955 | France | 52/749 |

*Primary Examiner*—Johnny D. Cherry

*Attorney, Agent, or Firm*—Cushman, Darby & Cushman

[57] ABSTRACT

A device for applying mortar to the tops of the walls and webs of a hollow brick comprising an elongated plate having a back wall and handles whereby it may be manipulated. Mortar is carried on the plate and the amount so carried is determined by the height of the back wall.

8 Claims, 8 Drawing Figures

APPARATUS FOR USE IN BUILDING

Figure 1:
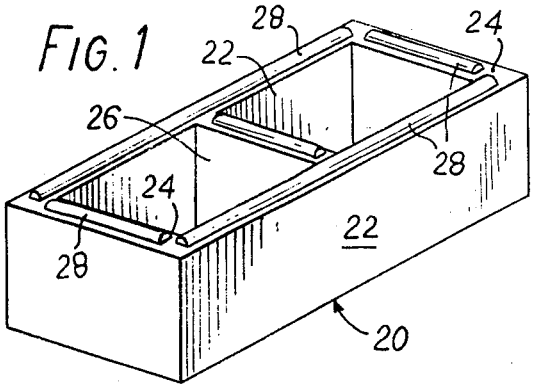

This is a continuation of Ser. No. 511,265, filed Oct. 2, 1974, now abandoned.

This invention relates to methods of and apparatus for use in building.

The invention is particularly concerned with such apparatus and methods when using hollow bricks (also known as breeze blocks) in the building operation.

BACKGROUND TO THE INVENTION

In known methods of building using hollow bricks, it is conventional to use a trowel to place the mortar on to the bricks. The trowel used is that which normally is used for placing mortar on to solid bricks. Unless the trowel is used with considerable skill, a substantial amount of the mortar will fall between the walls of the hollow brick. Additionally, to place the correct amount of mortar onto the walls of the brick is a task of some difficulty which is inordinately time consuming.

PROVISIONS OF THE INVENTION

According to one aspect of the present invention, there is provided a method of building using hollow bricks comprising using an elongated narrow device to lift and to transport mortar to the bricks and by tipping the device to place an elongated mound of mortar onto the brick walls.

According to another aspect of the invention, there is provided a device for use in building using hollow bricks, the device comprising an elongated plate, handle means for manipulating the plate and stop means for controlling the amount of mortar that can be placed on the plate. The stop means is conveniently a wall located at one of the longer edges of the plate and preferably running the entire length of this edge. The plate and wall are preferably integral and may be made from a length of angled metal, preferably steel.

The handle means may comprise a single bar upstanding from the wall, a pair of spaced bars or a continuous bar. Alternatively, the plate and wall may be formed from sheet material and an aperture may be cut in the wall to form a grip whereby the device may be handled by a workman.

Embodiments of the invention will now be described by way of example with reference to the accompanying drawings.

SHORT DESCRIPTION OF DRAWINGS

Figure 3:
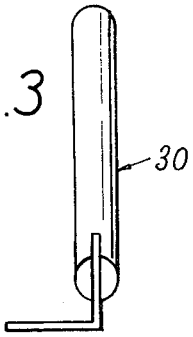
Figure 2:
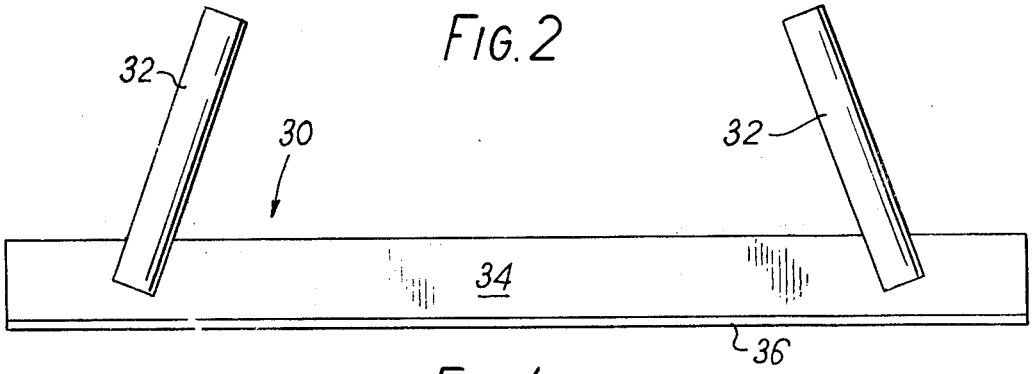
Figure 4:
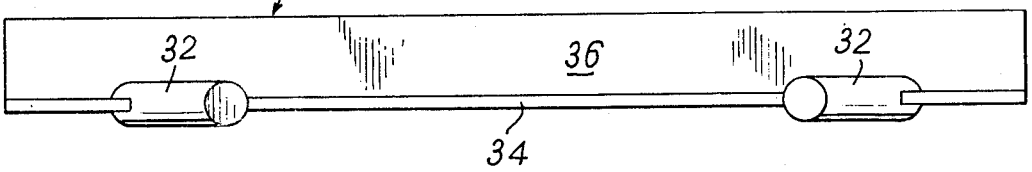
Figure 5:
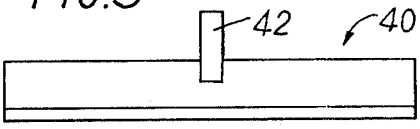
Figure 6:
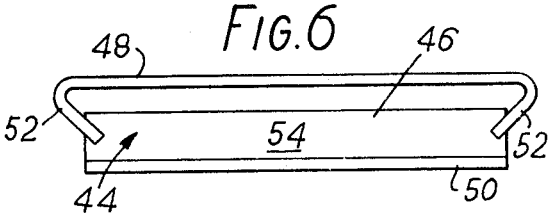
Figure 8:
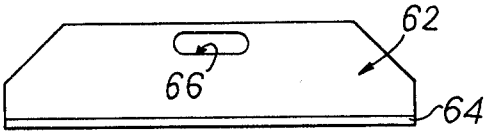

In the drawings:

FIG. 1 is a perspective view shewing the application of mortar to a hollow brick in accordance with the invention, FIGS. 2, 3 and 4 are respectively front, side and plan views of a building device of the invention, FIGS. 5 and 6 are front views of modified devices of the invention to a smaller scale than FIGS. 2 to 4, FIG. 7 is a front view of the device of the invention for applying mortar to the webs of the hollow brick, and FIG. 8 is a perspective view of a modified device of the invention formed from pressed sheet material.

Referring now to FIG. 1, there is shown a hollow brick 20 having two side walls 22 and three transverse webs thereof the outer webs 24 form end walls for the brick and the other web 26 forms a central stiffener for the brick. For building purposes, mortar is placed in an elongated mound 28 on the upper edges of the walls and webs as shown.

PREFERRED EMBODIMENT OF INVENTION (FIGS. 2, 3 and 4)

The device 30 of the invention for applying the mortar comprises an extruded or rolled steel angle member which is of the same length as the brick 20. The member comprises two elongated narrow webs 34 and 36 both of which are rectangular in shape and are located at approximately right angles to each other. Two handles 32 are welded to one of the webs 34 of the angle member close to its ends and being inwardly sloping to facilitate handling of the device 30.

In use, the workman holds the handles 32 with the lower web 36 extending towards him and draws the device into a mass of mortar. Mortar will now be picked up on the lower web 36 which forms a carrier plate. The amount of mortar thus picked up will be controlled by the upright web 34 which forms a back wall and stop means for the device. The workman brings the device to the brick 20 so that the edge 38 of the plate 36 butts against an edge of a side wall 22. The device 30 is then tipped about edge 38 and the mortar 28 is thus placed on to the upper surface of this side wall 22. The process is repeated for the other side wall and building can continue in the conventional manner.

The angle member may be of any convenient dimensions. Typically, however, the angle member is a 38 mm × 38 mm × 3 mm member which is about 470 mm long. It will be noted that the ratio of length to width of the lower web 36 is about 12 to 1. The ratio of length to height of the wall 34 is also about 12 to 1. The handles 32 are conveniently about 50 mm from the ends of the member and about 95 mm of the handles extend above the upper edge of the web or wall 34. The inclination of the handles is conveniently 70°.

FURTHER EMBODIMENTS OF THE INVENTION

The device 40 shown in FIG. 5 is generally similar to the device 30 save that a single centrally located vertical handle 42 is provided on the upright rear web instead of the pair of handles 32.

The device 44 of FIG. 6 comprises an angle member 46 which is identical to that of the member 30. However, the handle 48 is here formed from a continuous length of bar or tube which is arranged parallel to the plate 50 and which has its ends 52 bent down and welded to the ends of the back wall 54.

Figure 7:
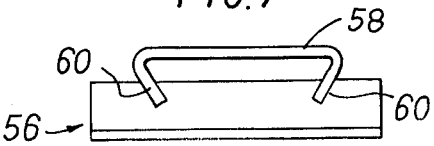

The device 56 of FIG. 7 is generally similar to the device 44 having a continuous bar or rod handle 58. However, the ends 60 of the handle 58 are bent down and welded to the upright edge about a third of the way from the nearer edges respectively. Also the length of the device 54 is considerably smaller than that of the device 44 so that the device 54 can be used for applying mortar to the upper faces of the brick webs 24 and 26 where this is required to comply with specification or architects requirements.

In FIG. 8 there is shown a device 62 which is formed from sheet steel. The device has its lower portion 64 bent at right angles to the remainder of the body to form a carrier plate. An aperture 66 is cut into the body of the device 62. This aperture 66 is of such dimensions and shape that the device 62 can be easily grasped by a workman for carrying out the operation described above.

GENERAL

It will be understood that a fairly firm mixture of mortar must be used when carrying out the above operations.

I have found that the operations above described can be carried out much more quickly and accurately than can the application of mortar to hollow bricks using conventional methods and a conventional trowel. Further, I have found that the amount of mortar spilling over the sides of the walls (and webs) of the hollow brick can be held to a minimum so that there can be a large saving in material when building by the method of the invention.

The invention is not limited to the precise constructional details hereinbefore described and illustrated in the drawings. For example, the angle member may be of different material, and the handle means may be of different shape. The handle means may be secured to the device in any desired manner, e.g. by rivets or bolts. A wooden, plastics or other grip device may be mounted on the handles to facilitate manipulation thereof.

I claim:

1. A device for applying a thin bead of mortar to hollow blocks for building, the device comprising:

(a) an elongated, flat, narrow plate having a continuous surface, (b) substantially straight and continuous stop surface means located at substantially right angles to and running along the length of the plate, the said stop surface means controlling the amount of mortar that can be placed upon the plate, and (c) handle means for manipulating the plate, which handle means includes a pair of bars connected to the stop surface means intermediate its length at separated locations for being manually grasped to apply said bead and extending upwardly from said stop surface means.

2. A device as claimed in claim 1 in which the stop surface means comprises a wall located at one of the longer edges of the plate.

3. A device as claimed in claim 2 in which the wall runs along the entire length of the said edge of the plate.

4. A device as claimed in claim 3, in which both the plate and the wall have rectangular surfaces.

5. A device as claimed in claim 2 in which the wall and plate are integral.

6. A device as claimed in claim 5 in which the wall and plate are constituted by webs of a length of angle metal.

7. A device as claimed in claim 1, in which the bars converge towards each other.

8. A device as claimed in claim 1, in which the width of the plate is approximately one-twelfth of its length.

* * * * *